US006405375B1

(12) United States Patent
Sardi

(10) Patent No.: US 6,405,375 B1
(45) Date of Patent: Jun. 18, 2002

(54) LOW DENSITY SEMIFINISHED PRODUCT FOR MANUFACTURING BUOYANT PRODUCTS

(75) Inventor: Gianluca Sardi, Arezzo (IT)

(73) Assignee: Float S.r.l., Livorno (IT)

( * ) Notice: Subject to any disclaimer, the term of this patent is extended or adjusted under 35 U.S.C. 154(b) by 0 days.

(21) Appl. No.: 09/254,332

(22) PCT Filed: Aug. 28, 1997

(86) PCT No.: PCT/EP97/04694

§ 371 (c)(1),
(2), (4) Date: Mar. 3, 1999

(87) PCT Pub. No.: WO98/09544

PCT Pub. Date: Mar. 12, 1998

(30) Foreign Application Priority Data

Sep. 4, 1996 (IT) ..... MO96A0111

(51) Int. Cl.[7] ..... A41D 5/00; B32B 3/06

(52) U.S. Cl. ..... 2/67; 2/82; 2/87; 2/272; 428/102; 428/138

(58) Field of Search ..... 428/102, 138; 2/67, 82, 87, 401, 267, 272

(56) References Cited

U.S. PATENT DOCUMENTS

| | | | |
|---|---|---|---|
| 4,281,428 | A | 8/1981 | Morris |
| 5,021,280 | A | 6/1991 | Brian et al. |
| 5,249,307 | A | 10/1993 | Lemoine |
| 5,267,519 | A | 12/1993 | Wendell et al. |

FOREIGN PATENT DOCUMENTS

| | | |
|---|---|---|
| EP | A-0246812 | 11/1987 |
| FR | A-2724569 | 3/1996 |
| WO | A-94227123 | 10/1994 |

*Primary Examiner*—John J. Calvert
*Assistant Examiner*—Robert H. Muromoto
(74) *Attorney, Agent, or Firm*—Guido Modiano; Albert Josif; Daniel O'Byrne

(57) ABSTRACT

Low density semifinished product for manufacturing buoyant products, comprising a plurality of layers of closed-cell expanded material, having a specific gravity lower than that of water, the said layers being flexible and elastic and being joined together by quilting spaced so as to define between them pockets of air, characterised in that the said quilting is preferably distributed in closed patterns.

12 Claims, 9 Drawing Sheets

LOW DENSITY SEMIFINISHED PRODUCT FOR MANUFACTURING BUOYANT PRODUCTS

BACKGROUND OF THE INVENTION

The invention concerns a low density semifinished product for manufacturing buoyant products, comprising a plurality of layers of closed-cell expanded material, having a specific gravity lower than that of water, the said layers being flexible and elastic and being joined together by means of consecutive quilting spaced so as to define pockets of air between them to increase buoyancy.

Such a semifinished product, classified in the category of "non-woven fabric", is employed mainly for manufacturing items of clothing, such as jackets, overalls, items of clothing for specific uses, for fishing, sailing, or other activities, particularly for use in marine or aquatic environments in general, and for manufacturing objects aiding in natatorial activities, as well as bags, or holders in general for use in proximity to these environments and which require protection against the risk of sinking.

Conventional items of clothing that enable a person to remain afloat are most uncomfortable and do not allow the degree of agility of movement that would be preferable when carrying out working activities, or sporting activities, or other types of activities.

Furthermore, when manufacturing buoyant products in general, to obtain holders, covers, bags, or other items, a limitation has been found consisting of the fact that it is necessary to adopt special manufacturing processes which entail considerable costs. Also, the products obtained with these processes turn out to be rigid and difficult to handle.

Examples of products having buoyant characteristics are available from the documents U.S. Pat. No. 5,267,519, FR-A-2.724.569 and, in particular, from WO-A-9422712, the last one teaching a product based on a plurality of superimposed layers.

Such prior art may be subject to further improvements with a view to eliminating the said drawbacks.

From the foregoing emerges the need to solve the technical problem of inventing a semifinished product that is suitable for manufacturing, in an extremely simple manner, buoyant products or that assist buoyancy, such as items of clothing, that are soft and easy to handle; in the case of clothing, these have to offer an adequate degree of buoyancy without excessively limiting freedom of movement.

SUMMARY OF THE INVENTION

The invention solves the said technical problem by adopting a semifinished product of the type mentioned in the preamble characterised in that the quilting is preferably arranged in closed patterns.

This considerably improves the buoyancy in water of objects made with the semifinished product, in that it creates a series of pockets in which air is—so say—trapped, providing a more stable and long-lasting aid to buoyancy.

The closed patterns may also be obtained with cross quilting; in this case, the items of clothing manufactured with such a semifinished product have an improved wearability and are more comfortable.

The cross quilting also confers a particular resistance to mechanical stresses to the semifinished product, especially during processing, in that it keeps the layers securely joined together.

As a result of this invention it is possible to manufacture buoyant products of pleasant appearance, substantially without imposing limitations on the creative impulse of fashion designers, in that the semifinished product may substantially be processed like a fabric and may be inserted in any type of item of clothing, or accessory, without compromising the look and/or the practicality of said item.

BRIEF DESCRIPTION OF THE DRAWINGS

Some embodiments of the invention are illustrated, merely by way of non-limitative examples, in the accompanying drawings and wherein:

FIG. 5 a handbag, FIG. 6 a tennis racket cover, FIG. 7 a belt bag, FIG. 8 a glasses case, FIG. 9 an envelope, FIG. 10 a wallet, FIG. 11 a fishing rod case, FIG. 12 a camera bag, FIG. 13 a vanity case, FIG. 14 a shoulder bag, FIG. 15 a bag with handles, FIG. 16 a travel bag, FIG. 17 a rucksack, FIG. 18 a sleeveless jacket, for going fishing, FIG. 19 a waistcoat, FIG. 20 a jacket with integrated hood, FIG. 21 a jacket with removable hood, FIG. 22 a life jacket, FIG. 23 a jacket for learning to swim, FIG. 24 a short single-piece jacket for surfers; FIG. 25 a jacket and trousers combination.

DESCRIPTION OF THE PREFERRED EMBODIMENTS

Figure 1:
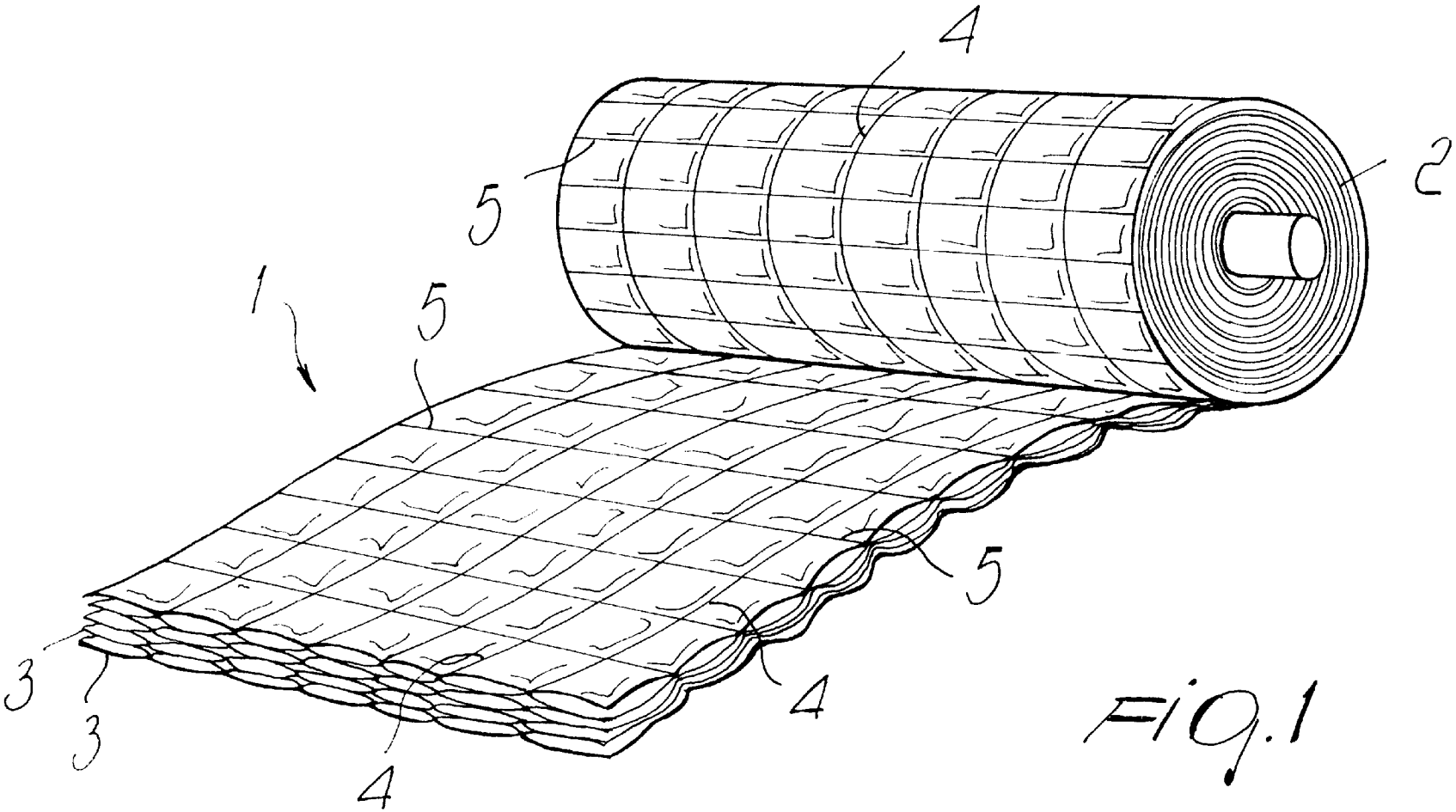
FIG. 1 is a perspective view of a roll of material in superimposed quilted layers, partially unwound, constituting the semifinished product.

The material for manufacturing buoyant products, in the form of non-woven fabric 1, wound onto a roll 2, comprises a plurality of layers 3, joined together, preferably by means of quilting, in a longitudinal direction 4 extending in the direction of the length of each layer 3 and in a traverse direction 5 perpendicular to the previous direction.

Each layer 3 is made of a material with a specific gravity lower than that of water, preferably an expanded material with closed compartments which, overall, is soft and very flexible; the thickness of each layer is approximately 1 mm.

Optimum results have been achieved with closed-cell expanded polyethylene.

The quilting 4, 5 joins two superimposed layers and define in the material 1 a plurality of closed areas, for example, squared, in which air is partially trapped for buoyancy and operating also as structural reinforcement. Cross-quilting prevents the material for becoming excessively stiff.

The material 1 may also be provided with a lining, particularly but not exclusively when manufacturing clothes.

Figure 2:
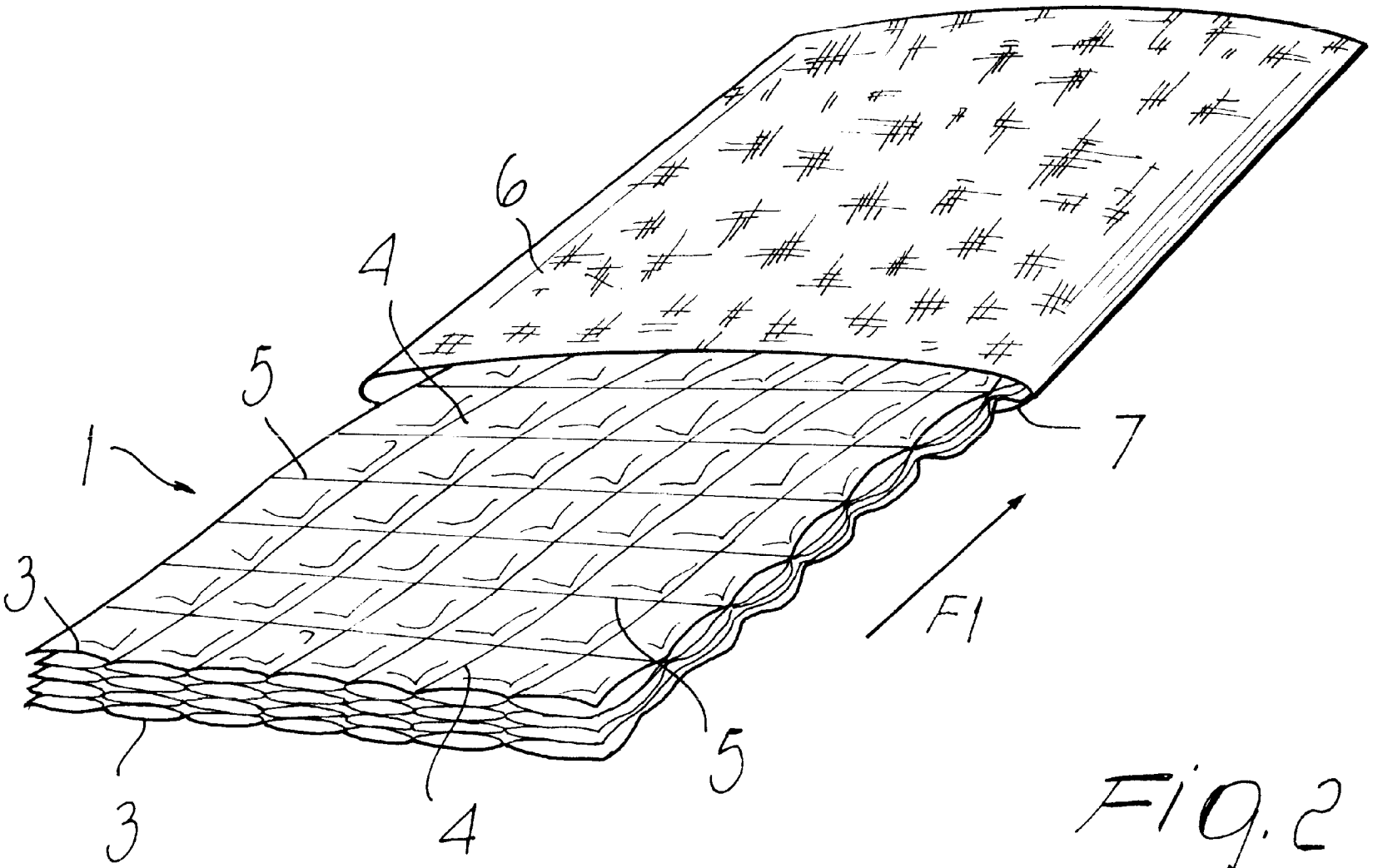
FIG. 2 is a perspective view of a portion of semifinished product partially inserted in a lining in the form of a pocket.

FIG. 2 shows how the material may also be inserted, in the direction indicated by arrow F1, through an open side 7 of a lining 6 in the form of a pocket, so as to act as padding for the said lining. This makes the manufacture of elements making up items of clothing and objects of various types and functions particularly simple to manufacture.

In general, the semifinished product may therefore act as padding in the manufacture of any type of object.

Figure 3:
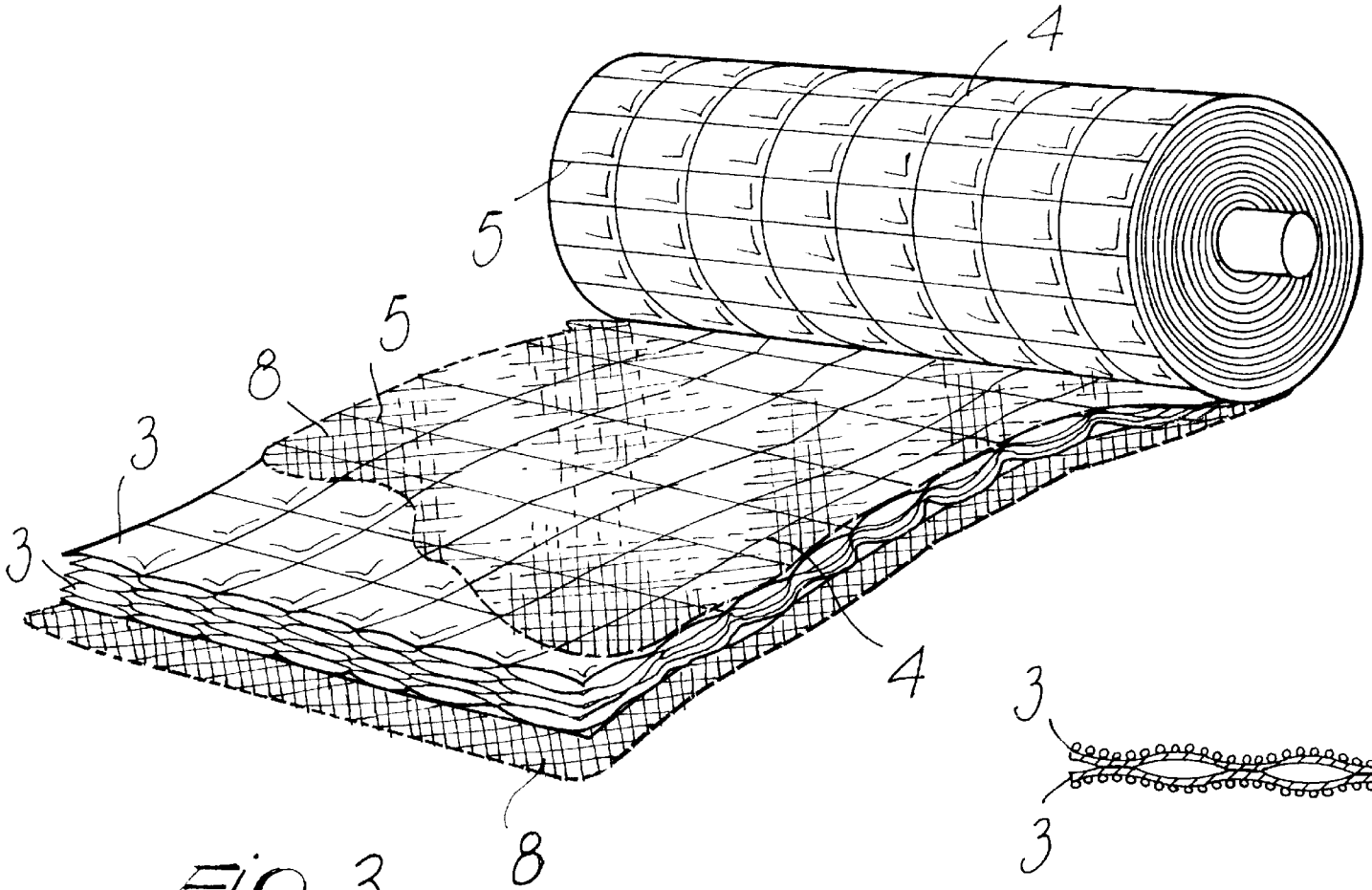
FIG. 3 is a view as in FIG. 1, but with the semifinished product inserted between a pair of net elements to assist the quilting.
Figure 4:
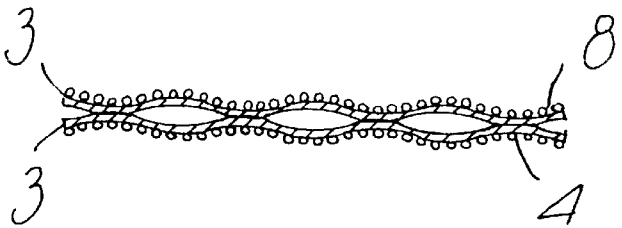
FIG. 4 is section IV—IV, partial and enlarged, of FIG. 3.
Figure 7:
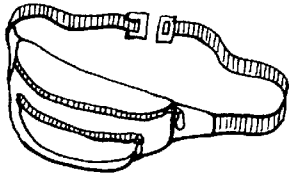
FIGS. 5 to 25 show some examples of products manufactured using the semifinished product according to the invention, and show in order.
Figure 10:
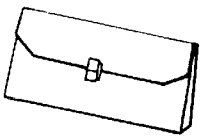
Figure 13:
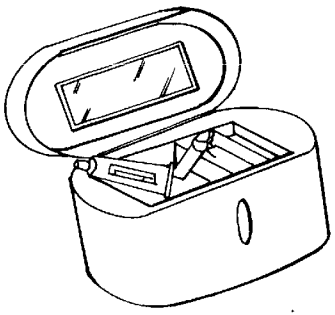
Figure 6:
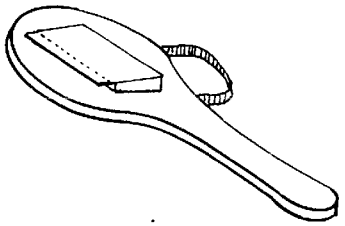
Figure 9:
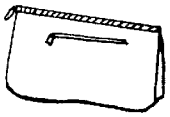
Figure 12:
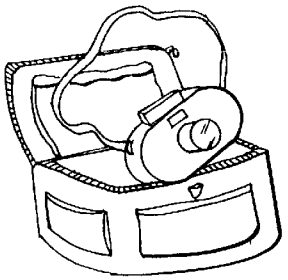
Figure 5:
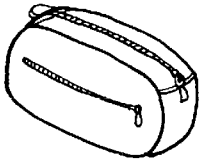
Figure 8:
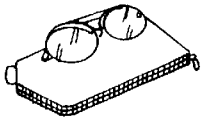
Figure 11:
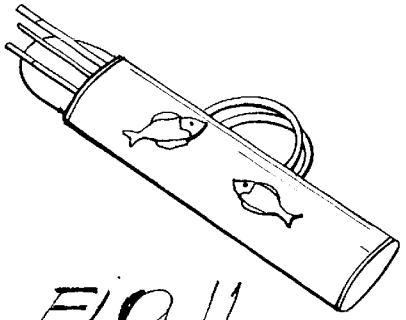
Figure 14:
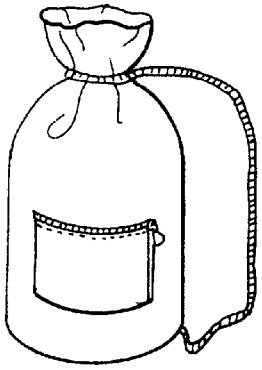
Figure 15:
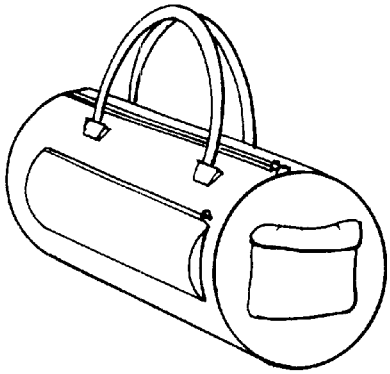
Figure 16:
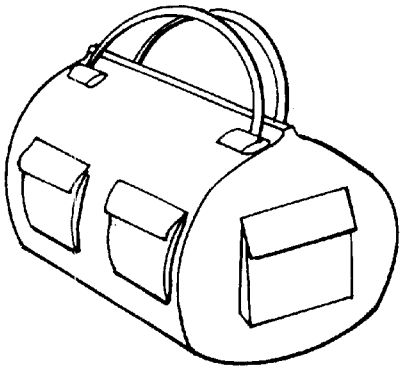
Figure 17:
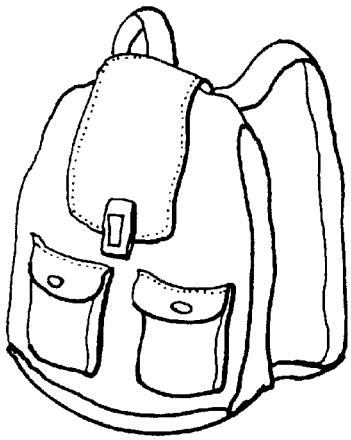
Figure 18:
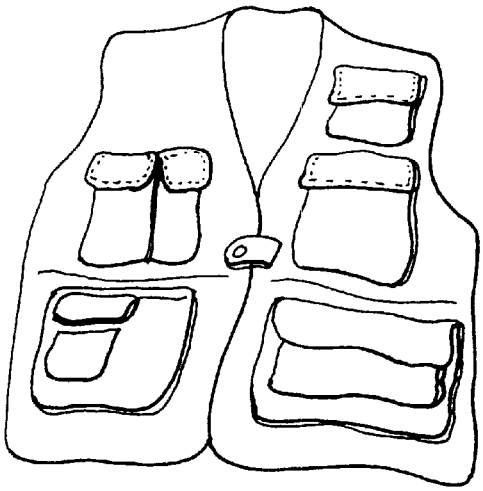
Figure 19:
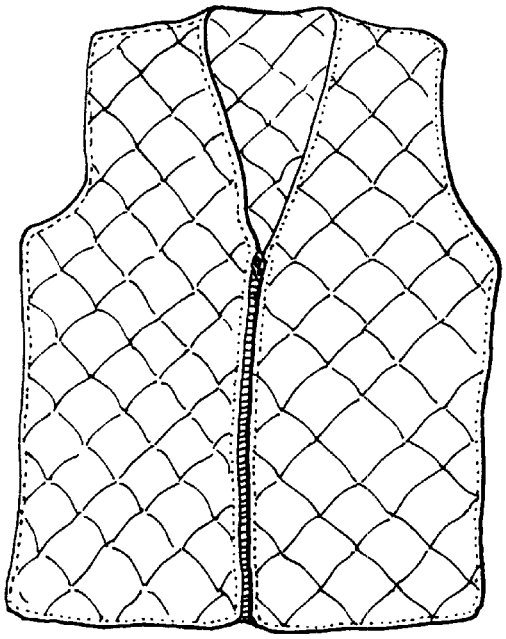
Figure 20:
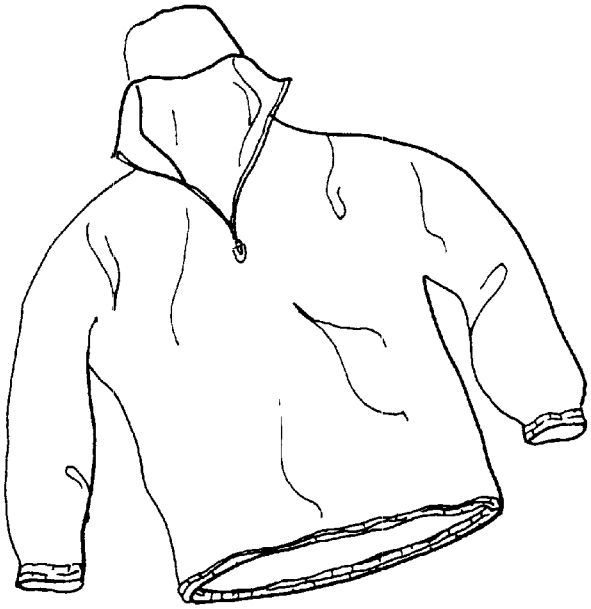
Figure 21:
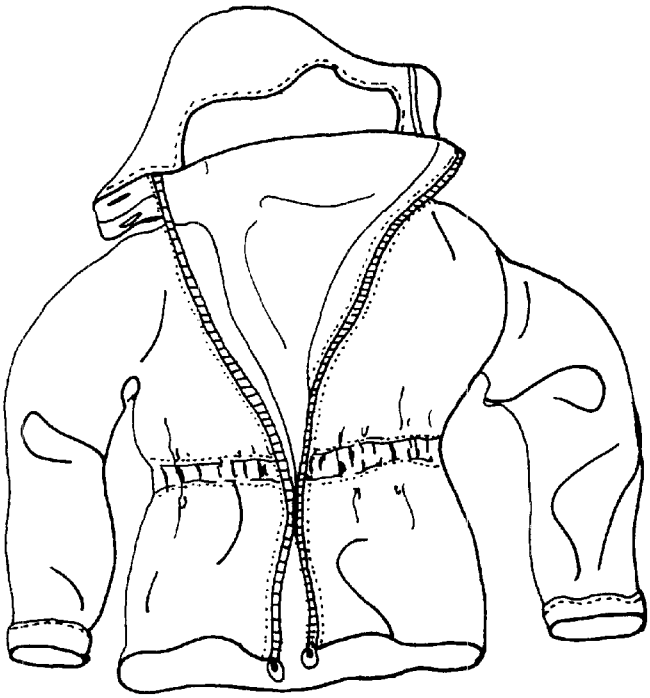
Figure 22:
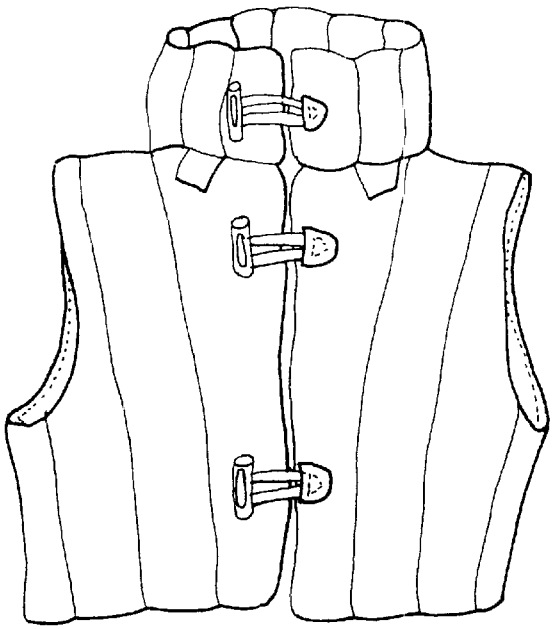
Figure 23:
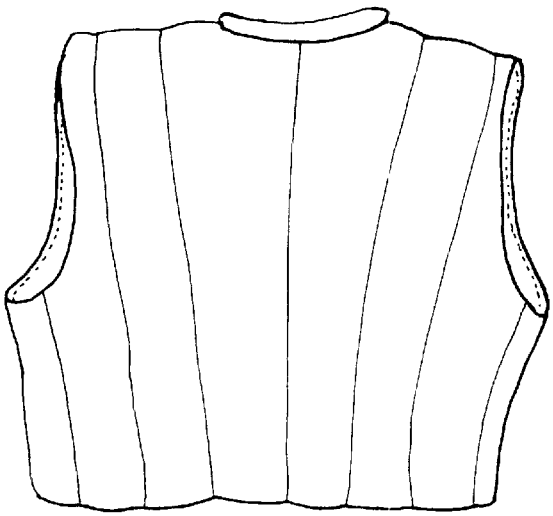
Figure 25:
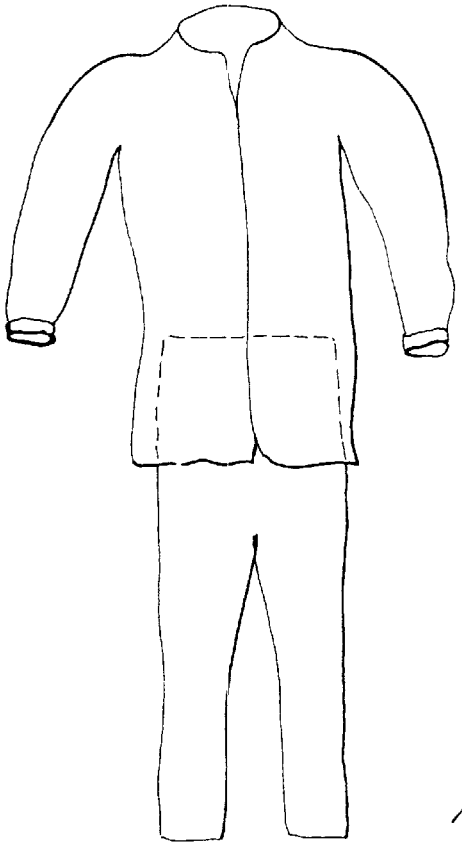
Figure 24:
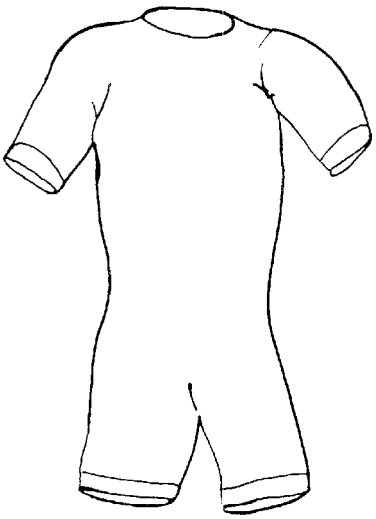

As shown in FIG. 3, the set of layers 3 may be sandwiched between a pair of net elements 8, joined to the sheets 3 by means of the same quilting 4, 5 that interconnects the sheets 3. The adoption of at least one flat net element 8 renders the semifinished product easier to work, in that the sheets are considerably easier to pull under the heads of the sewing machines.

Also, the net element prevents one or more of the sheets, that are made of a very soft material, from being cut by the thread used for the quilting. To this end, the net element 8 has to be very strong, but of reduced thickness, to prevent the product from becoming excessively rigid.

Experimental results have shown that items of clothing made with the semifinished product 1 are able to meet the most exacting safety regulations for nautical equipment.

It has also been found that the items of clothing made with this product provide excellent protection against wind, cold and atmospheric agents in general, in that they provide a high degree of thermal insulation. The material can therefore be used as padding for jackets, overalls, boots, in particular ski-boots.

In practice the materials, dimensions and details of execution may be different from, but technically equivalent to those described without departing from the scope of the present invention.

For example, the type of stitching used for the quilting may vary in function of manufacturing requirements.

What is claimed is:

1. Low density semifinished product for manufacturing fashion designer items having buoyancy properties, comprising: a plurality of superimposed layers of closed-cell expanded material having a specific gravity lower than that of water, said layers being flexible and elastic and having each a thickness of about 1 mm; cross-quiltings distributed over the entire surface of said superimposed layers according to a selectable pattern, so as to act as a structural reinforcement, and to impart flexibility to the product; and a plurality of closed air pockets, formed by said cross-quiltings, so as to provide groups of multiple adjacent buoyancy elements for any piece cut from said product according to a desired cutting pattern.

2. The semifinished product of claim 1 further comprising a net element, at least external layers of said plurality of superimposed layers being externally associated with a said net element.

3. The semifinished product of claim 2, wherein said expanded material is closed-cell expanded polyethylene.

4. The semifinished product of claim 2, wherein said plurality of superimposed layers are in such a number so that an ensemble is obtained which has cutting and assembling qualities being analogous to that of a fabric.

5. The semifinished product of claim 4, further comprising a lining, said lining being applicable upon manufacturing a finished item.

6. The semifinished product of claim 4 having such a number of superimposed layers so as to constitute a padding element insertable in padded items with buoyancy properties.

7. Low density semifinished assembly for manufacturing items having buoyancy properties, comprising: a plurality of superimposed layers of closed-cell expanded material having a specific gravity lower than that of water, said layers being flexible and elastic and having each a thickness of approximately 1 mm; cross-quiltings distributed over the entire surface of said superimposed layers, according to a selectable pattern, so as to constitute a structural reinforcement, and to impart flexibility to the assembly; and a plurality of closed air pockets, confined by said cross-quilting, so as to provide, upon cutting of the assembly according to any desired cutting pattern, groups of separate and adjacent buoyancy elements.

8. A method for producing a semifinished product for manufacturing fashion designer items having buoayncy properties, comprising;

providing a plurality of layers of closed-cell expanded material having a specific gravity lower than that of water, said layers being flexible and elastic and having each a thickness of about 1 mm;

arranging said plurality of layers in a superimposed configuration;

cross-quilting said superimposed layers over the entire surface thereof so as to form a selectable pattern acting as a structural reinforcement, while maintaining flexibility of the product;

forming a plurality of closed air pockets each confined within a quilted contour, said closed air pockets having such dimensions and being so distributed so as to provide groups of adjacent buoyancy elements upon cutting of the product according to any cutting pattern selectable for producing a finished item.

9. The method of claim 8, comprising the steps of associating externally, with at least one external layer of said plurality of superimposed layers, a respective net element, pulling the product with the net element under the head of a sewing or quilting machine, and cross-quilting at the same time said net element and said superimposed layers.

10. The method of claim 9, comprising a further step of attaching a lining to said quilted superimposed layers.

11. The method of claim 9 comprising an additional step of cutting said cross-quilted superimposed layers according to a cutting pattern for obtaining cut elements, each having buoyancy properties, said cut elements constituting components of a container.

12. The method of claim 8, comprising an additional step of cutting said cross-quilted superimposed layers, according to a cutting pattern for obtaining cut elements having each buoyancy properties, said cut elements constituting components of clothing items.

* * * * *